United States Patent [19]

Streisel

[11] 4,220,132

[45] Sep. 2, 1980

[54] GAS-FIRED RADIANT BURNER

[75] Inventor: John P. Streisel, Parma, Ohio

[73] Assignee: The Barber Manufacturing Company, Bedford Heights, Ohio

[21] Appl. No.: 969,015

[22] Filed: Dec. 13, 1978

[51] Int. Cl.[2] ..... F23C 5/00

[52] U.S. Cl. ..... 126/271.2 R; 126/92 AC; 126/90 R; 431/328

[58] Field of Search ..... 126/271.1, 271.2 R, 126/271.2 A, 271.2 C, 91 R, 92 R, 92 AC, 87, 88; 431/328, 329, 351, 352

[56] References Cited

U.S. PATENT DOCUMENTS

| | | | |
|---|---|---|---|
| 1,493,204 | 5/1924 | Humphrey | 126/92 R |
| 2,771,132 | 11/1956 | Fault | 126/92 R |
| 2,820,450 | 1/1958 | Zimmerman | 126/271.2 A |
| 2,980,104 | 4/1961 | Patrick et al. | 126/271.2 R |
| 3,445,175 | 5/1969 | Krieger | 431/328 |
| 3,805,763 | 4/1974 | Cowen | 126/92 R |
| 3,912,443 | 10/1975 | Ravault et al. | 431/328 |
| 4,048,113 | 9/1977 | Risse | 431/328 |

FOREIGN PATENT DOCUMENTS

| | | | |
|---|---|---|---|
| 526728 | 3/1954 | Belgium | 431/329 |
| 1551376 | 11/1968 | France | 126/92 AC |

*Primary Examiner*—James C. Yeung

*Attorney, Agent, or Firm*—Pearne, Gordon, Sessions

[57] ABSTRACT

A gas-fired radiant heater such as for thawing rail cars and their contents in car barns and the like during freezing weather. The heater has an elongated housing that supports a channel box and an elongated perforated semi-cylindrical mantle supported by the housing over the channel box. The channel box receives a quantity of loosely-packed, fibrous ceramic refractory material that becomes incandescent when heated. The ceramic material has an exposed upwardly facing fibrous surface that defines with the interior of the mantle an elongated combustion chamber. The ends of the combustion chamber are closed and an ignited mixture fuel gas and air is projected into the elongated combustion chamber in the form of a flame jet. The flame jet heats the fibrous ceramic material and the mantle to incandescence so that the upwardly facing surface of the refractory material and the mantle radiate heat energy in a pattern generally normal to the surface of the mantle.

2 Claims, 4 Drawing Figures

GAS-FIRED RADIANT BURNER

BACKGROUND OF THE INVENTION

This invention relates to radiant heaters and especially to gas-fired heaters adapted to generate radiant energy in the infra-red range. More particularly the invention relates to directional gas fired radiant heaters that utilize a specially shaped mantle of incandecent material enclosing a portion of a combustion chamber and a reflective metal backing wall over the opposite portion.

The invention has particular utility in connection with heaters for thawing raw bulk material such as coal in rail cars—normally hopper cars—although the invention is not limited to that application. Usually coal for use at power generating stations arrives during winter months in open coal cars and considerable moisture in the form of rain or snow wets the coal over a period of time and, when the moisture freezes, tends to bond the coal together in a frozen mass.

Coal in that condition is difficult to handle and accordingly it is desirable to thaw the coal within the rail car in an enclosure or car barn. The thawing is often accomplished with gas fired radiant heaters located on the ground or floor below the coal car and adjacent the rails.

A typical prior art type burner for that purpose is disclosed in U.S. Pat. No. 2,980,104. In that device, fuel gas from a supply line is mixed with air in a mixing tube to provide a desired combustion mixture. Then the mixture is fed to an elongated burner tube with radial flame ports. The mixture is ignited at the ports in an elongated combustion chamber surrounded on the upper portion by an incandescent mantle formed for example, of a uniformly perforated sheet of stainless steel designed to withstand working temperatures of from 1600 to 1700° F.

The ports of the burner tube have usually been located in the top portion of the tube so that the flames extend generally upwardly to heat the mantle to incandescense. Any radiation in a downward or lateral direction not within the zone of the mantle was mostly of little effectiveness as far as radiating heat energy to the rail car. This limited the efficiency of the burner and to some extent resulted in wasted fuel.

Another problem with prior art burners of the type described is the long period of heat retention after the burner is shut off. This heat retention is due in large part to heavy metal castings—particularly the cart burner tub. This problem is particularly significant with respect to use of such burners to thaw rail cars where moving cars commonly leak oil or fuel.

The radiant heater of the present invention; however, avoids the disadvantages described above and affords other features and advantages heretofor not obtainable.

SUMMARY OF THE INVENTION

It is among the objects of the invention to improve the transfer of radiant heat energy from a gas fired heater, to the surfaces to be heated.

Another object is to improve the efficiency of gas-fired radiant heaters used for thawing bulk materials such as coal in rail cars.

Another object is to minimize the heat retention of such heaters after the unit is shut off.

These and other objects and advantages are achieved with the unique gas-fired radiant heater of the invention, the heater being particularly adapted for thawing rail cars and their contents in car barns during freezing weather. The heater has an elongated housing that supports a channel box in such a way as to accommodate heat expansion and which defines an elongated upwardly facing open channel. A quantity of loosely packed fibrous ceramic refractory material is positioned in the channel, usually in the form of rectangular blocks aligned end-to-end to define an upwardly facing exposed fibrous surface that becomes incandescent when heated.

Located over the housing and channel box is an elongated semi-cylindrical perforated mantle mounted to define with the exposed fiber surface an elongated combustion chamber. The ends of the combustion chamber are closed and a nozzle means at one end projects a burning mixture of fuel gas and air in the form of a flame jet into the combustion chamber to heat the fibrous ceramic refractory material and the mantle to incandescense. Accordingly, the fibrous ceramic refractory material adjacent the surface, and the mantle radiate heat energy in a pattern generally normal to the surface of the mantle in a manner that utilizes an optimum amount of the available radiant heat energy.

DESCRIPTION OF THE PREFERRED EMBODIMENT

Figure 1:
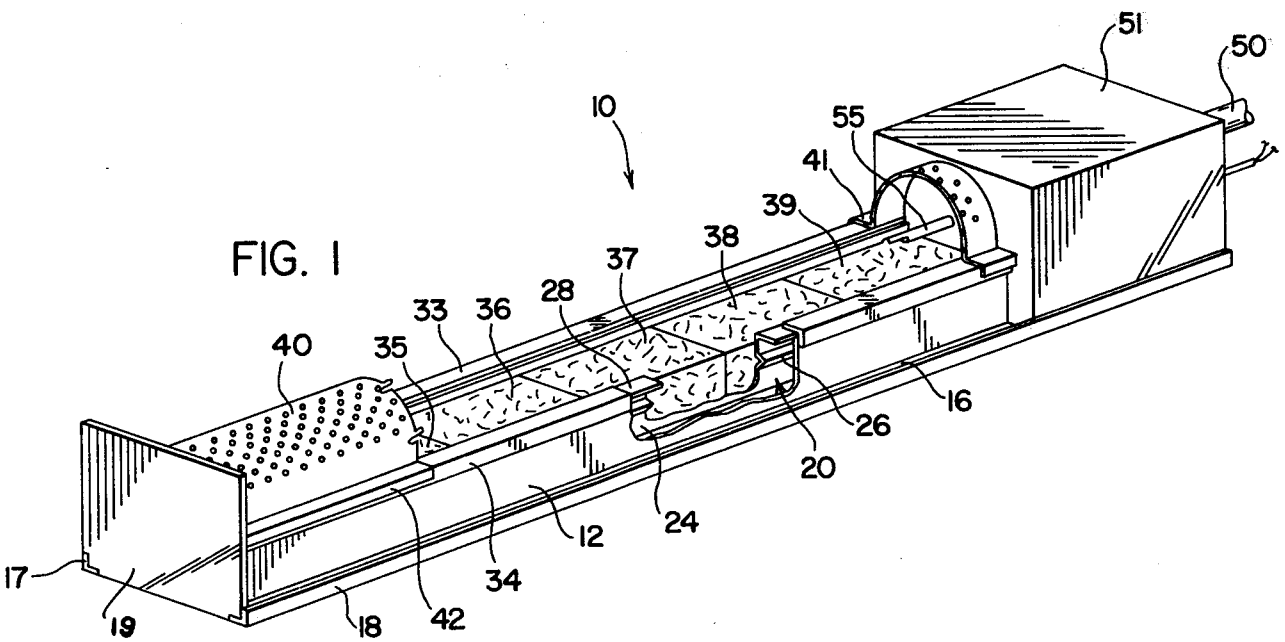
FIG. 1 is a perspective view of a gas fired radiant heater emboding the invention and with parts broken away for the purpose of illustration.

Referring more particularly to the drawings and initially to FIG. 1 there is shown a gas-fired radiant heater 10 designed especially for use in thawing rail cars and their contents in car barns and the like during freezing weather. The heater has a pair of elongated parallel sheet metal base members 11 and 12 with inwardly extending horizontal top flanges 13 and 14 and outwardly extending horizontal bottom flanges 15 and 16. The bottom flanges 15 and 16 rest on and are welded to a pair of parallel supports 17 and 18 respectively in the form of steel angle bars. An end plate 19 is welded to the base members 11 and 12 at the left hand end as viewed in FIGS. 2 and 3.

The base members 11 and 12 support a channel box 20 which has the form of an elongated fabricated sheet metal member that defines an elongated retangular channel 21 with a floor 22 and parallel vertical sidewalls 23 and 24. The sidewalls 23 and 24 each have a central, longitudinally extending, outwardly projecting reinforcing rib 25 and 26 respectfully which add increased rigidity to the channel box 20.

The channel box 20 has a pair of flat outwardly extending, horizontal side flanges 27 and 28 which are slidably received in respective slots 31 and 32 located between the flanges 13 and 14 of base members 11 and 12 and parallel rail members 33 and 34 in the form of steel angle bars that are welded to the base members 11 and 12 respectively with their horizontal webs spaced vertically from the flanges 13 and 14 to define the slots 31 and 32.

Thus, the channel box 20 is supported by the base members 11 and 12 and their respective rails 33 and 34 in a slidable manner to accommodate thermal expansion and contraction during operation of the heater.

Figure 4:
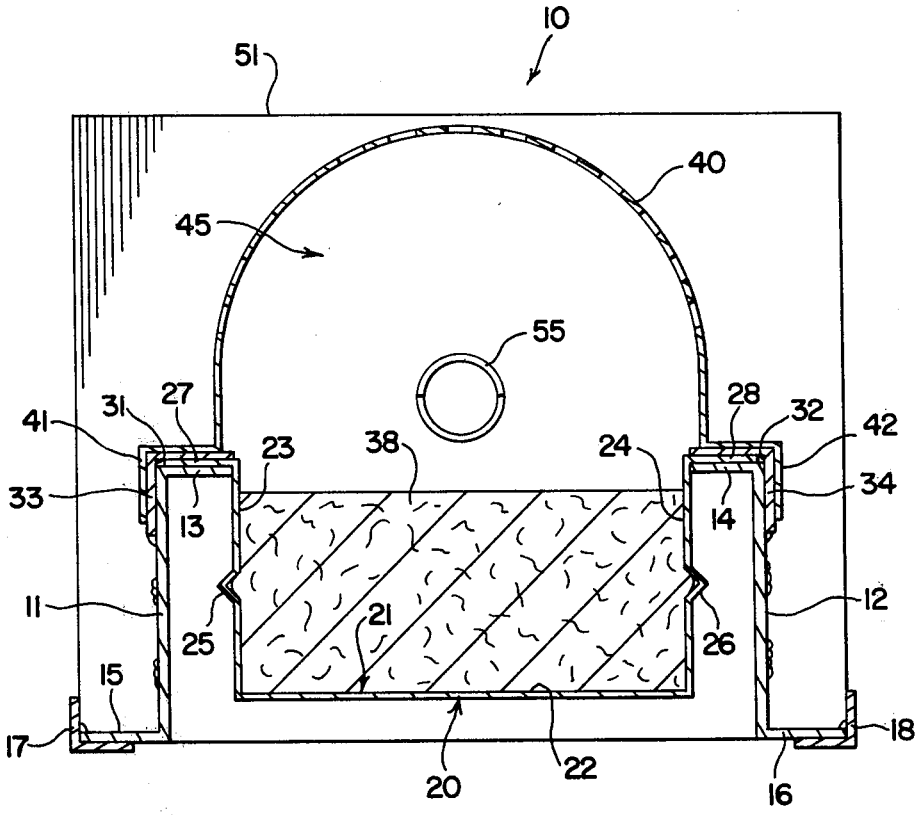
FIG. 4 is a sectional view taken on the Line 4—4 of FIG. 3.

Located over the channel box 20 is a semi-cylindrical perforated mantel 40 formed of incandescent material such as stainless steel and which has angle shaped parallel flanges 41 and 42 along its opposite sides that fit over the rails 33 and 34 as shown in FIG. 4.

Located in the elongated channel 21 in the channel box 20 are a plurality (in this instance 5) of ceramic felt blocks 35, 36, 37, 38, and 39 formed of a fibrous ceramic material that becomes incandescent when heated. The blocks are of rectangular form and are aligned end-to-end to define an upwardly facing exposed fibrous surface adapted to be heated to incandescense of a fuel gas and air mixture. The upper facing portion of the blocks 35, 36, 37, 38, and 39 define with the interior surface of the mantel 40, a combustion chamber 45 in which a mixture of fuel gas and air is burned.

Figure 2:
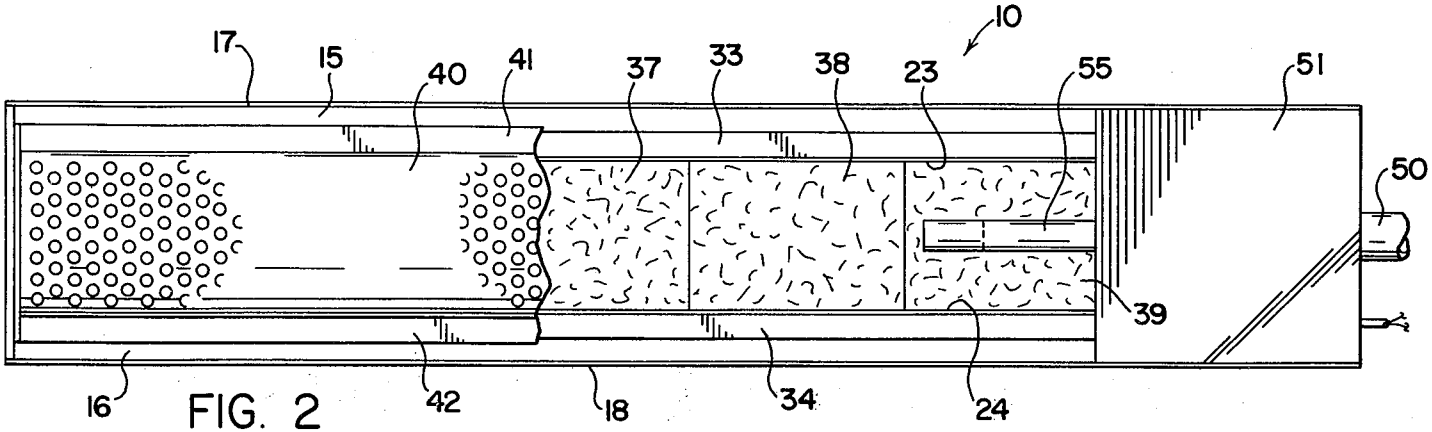
FIG. 2 is a plan view on an enlarged scale of the heater of FIG. 1 with parts broken away for the purpose of illustration.
Figure 3:
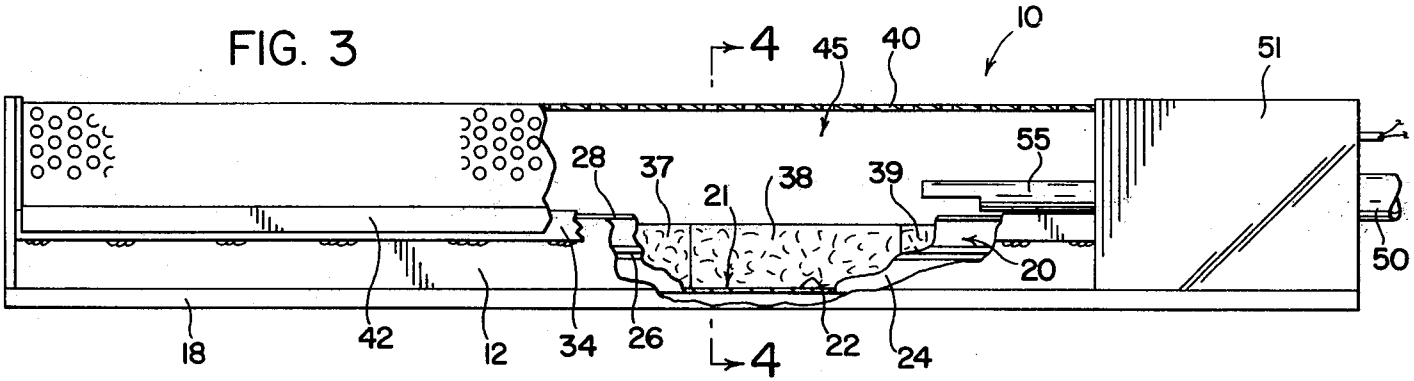
FIG. 3 is an elevational view of the heater of FIGS. 1 and 2 with parts broken away and shown in section for the purpose of illustration.

Fuel gas is supplied to the heater 10 through a fuel supply pipe 50 which connects to a fuel control unit (not shown) located in an enclosure 51 at the right hand end of the heater as viewed in FIGS. 1, 2, and 3. The fuel control unit may be, for example, any one of the units manufactured and sold by the Barber Manufacturing Company of Bedford Heights, Ohio, U.S.A. under trade designations SPNA, DSNC or D300. These control units generally include as conventional basic elements an ignition control, a flame detector, a venturi, an air shutter, an ignitor and a primary gas valve.

The fuel control unit when activated supplies a mixture of fuel gas and air to a nozzle 55 which extends into the combustion chamber 45. The fuel gas and air mixture is ignited and the nozzle 55 projects an elongated jet of flame into and through the combustion chamber 45, preferably a major portion of the total length thereof.

The flame heats the upwardly facing, exposed surfaces of the ceramic felt blocks 45, 46, 47, 48, and 49 and also the stainless steel mantel 40 to incandescense so that radiant heat energy is radiated from the mantel 40 and from the incadescent ceramic felt outwardly in a direction normal to the curved exterior surface of the mantel 40 to the rail car or to the like to be heated. This construction utilizes a maximum amount of the heat energy generated by the combustion of the fuel gas and air mixture with a minimum loss of energy through conduction in a direction away from the zone intended to receive radiant energy from the mantel.

The ceramic felt may be; for example, a product sold in block form by Pyro-Bloc Division of Stouter Industries in Des Plaines, Ill. under the trade designation "Pyro-Bloc." The fibers that form these fibrous blocks are white in color, have a melting point of 3260° F., a fiber diameter of from two to three microns, a fiber length of ten inches maximum, a specific gravity of 2.5 grams per cubic centimeter and a specific heat of 0.255 BTU's per lb. per °F. A typical chemical composition for the fiber would be as follows:

$Al_2O_3$: 48.0%
$SiO_2$: 51.9%
$Fe_2O_3$: 0.04%
Trace Inorganics: 0.06%
Leachable Chlorides: 50 ppm The advantages achieved through the use of the ceramic felt derive from the fact that the heat energy is absorbed for the most part only at the upper most layer of the ceramic felt blocks 35, 36, 37, 38, and 39 and retained in that layer since conduction is inhibited by the insulating properties of the blocks. Accordingly, the radiant energy is transmitted in the desired upward direction, normal to the surface of the mantel rather than laterally and downwardly through the thickness of the ceramic felt blocks. This results in vastly improved utilization of the available heat energy to heat a rail car and its contents to be thawed.

Also it will be noted that since heavy metal castings are not utilized in the heater construction of the invention and accordingly there is a rapid temperature decay rate when the unit is turned off.

While the invention has been shown and described with respect to a specific embodiment thereof, this is intended for the purpose of illustration rather than limitation, and variations and modifications of the specific device herein shown and described will be apparent to those skilled in this art, all within the intended spirit and scope of the invention. Accordingly, the patent is not to be limited in scope and effect to the specific embodiment, herein shown and described, nor in any other way that is inconsistent with the extent to which the progress in the art has been advanced by the invention.

I claim:

1. A gas-fired radiant heater comprising:

an elongated housing;

channel forming means movably supported by said housing to accommodate heat expansion and defining an elongated upwardly facing open channel;

a quantity of loosely packed fibrous ceramic refractory blocks that becomes incandescant when heated, positioned and aligned end to end in said channel to define an upwardly facing exposed fibrous surface;

an elongated perforate mantle mounted on said housing over said exposed fibrous surface to define therewith an elongated combustion chamber;

means for closing the ends of said combustion chamber and;

nozzle means at one end of said combustion chamber for projecting a burning mixture of fuel gas and air as a flame jet into said combustion chamber to heat said fibrous ceramic refractory material and said mantel to incandescense wherely said surface and said mantle radiate heat energy in a pattern generally normal to the surface of said mantle.

2. A gas fired radiant heater as defined in claim 1 wherein said fibrous ceramic refractory material comprises fibers compound of $Al_2O_3$ and $SiO_2$.

* * * * *